United States Patent [19]

Weidlich

[11] 4,090,483

[45] May 23, 1978

[54] CARBURETOR DEVICE, ESPECIALLY FOR INTERNAL COMBUSTION ENGINES

[76] Inventor: Franz Weidlich, Strandvägen 55, Sollentuna, Sweden, 191 45

[21] Appl. No.: 695,829

[22] Filed: Jun. 14, 1976

[30] Foreign Application Priority Data

Jun. 13, 1975 Sweden ..... 7506784

[51] Int. Cl.[2] ..... F02M 25/00

[52] U.S. Cl. ..... 123/119 A; 261/89; 261/DIG. 39

[58] Field of Search ..... 261/63, 50 A, 69 R, 261/64 A, 89, DIG. 39; 123/120, 121, 119 A, 141

[56] References Cited

U.S. PATENT DOCUMENTS

| | | | |
|---|---|---|---|
| 1,102,387 | 7/1914 | Britten | 261/89 |
| 1,465,574 | 8/1923 | Bannister | 123/133 |
| 2,314,170 | 3/1943 | Snyder | 261/89 |
| 3,439,903 | 4/1969 | Totnai | 261/89 |
| 3,846,094 | 11/1974 | Baverstock | 261/63 |

*Primary Examiner*—Ronald H. Lazarus
*Attorney, Agent, or Firm*—Kurt Kelman

[57] ABSTRACT

A carburetor for an internal combustion engine comprises a combustion air intake duct, a valve in the duct for controlling the air flow through the duct, a fuel flow regulator in the valve for controlling fuel flow through a downstream portion of the valve in dependence on the air flow, and a turbine associated with the fuel flow regulator and driven by the exhaust gases of the engine, the turbine having a rotating tubular hub extending through the valve and surrounding the fuel flow regulator, the tubular hub being connected to the fuel outlet through the valve.

7 Claims, 3 Drawing Figures

CARBURETOR DEVICE, ESPECIALLY FOR INTERNAL COMBUSTION ENGINES

The present invention refers to a carburetor device, especially for internal combustion engines.

In the general endeavor to fulfil promulgated environmental requirements regarding combustion of fossile fuels such as gasoline and the like, it has been attempted to achieve as uniform a fuel/air ratio as possible during the different working rotary speeds of an internal combustion engine. This is extremely difficult to attain in conventional types of carburetor with constant air through-flow area and fuel jet means in the air intake. A relationship between fuel and air which has been found to be nearly ideal is about 1:15.

The present invention proposes to a solution of the problem of attaining a substantially constant fuel/air relationship during varying rotary speed conditions of an internal combustion engine.

The distinguishing features of the present invention are apparent from the claims.

The invention will now be described in detail while referring to the appended drawings showing an embodiment thereof.

Figure 1:
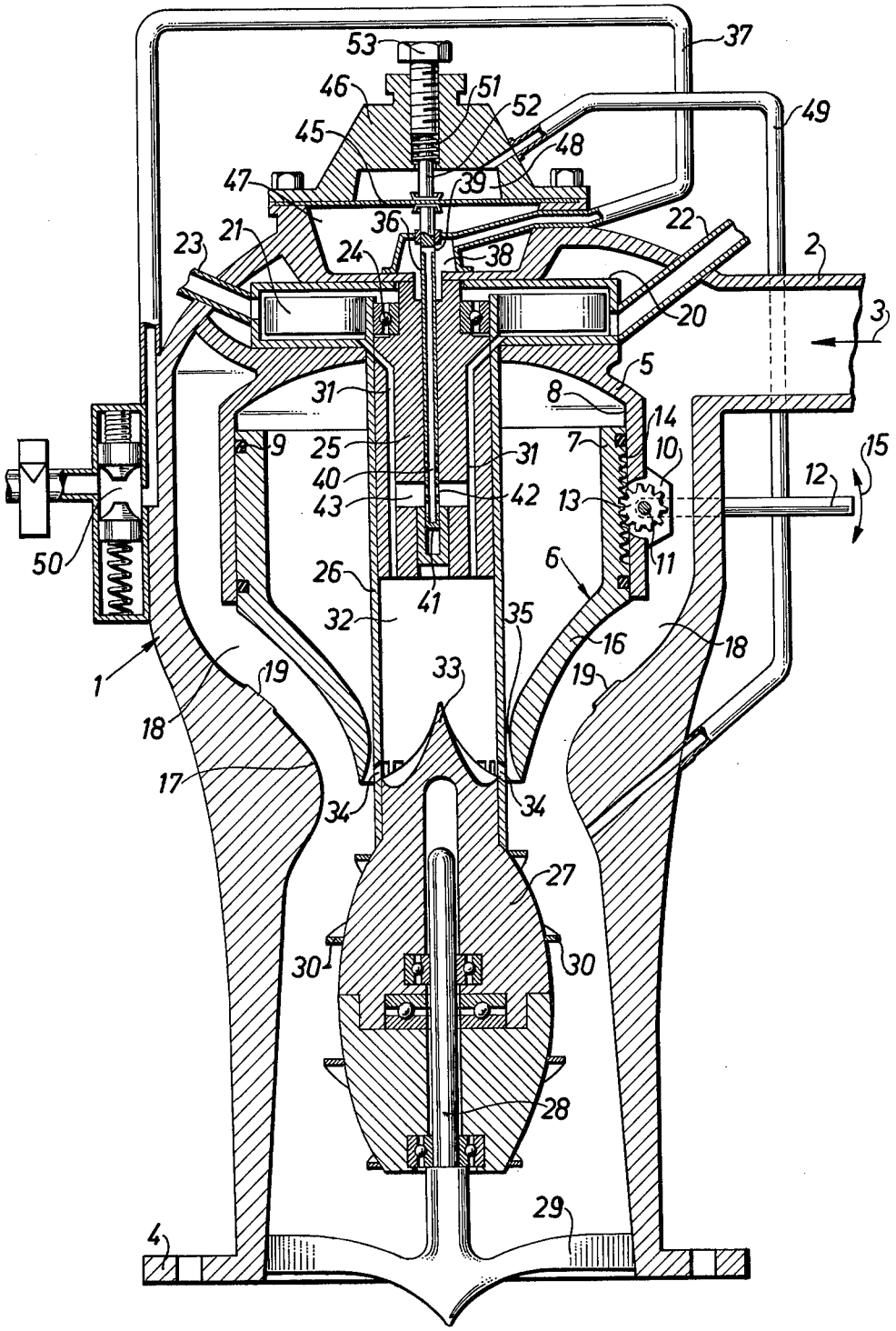
FIG. 1 shows a longitudinal section through a carburetor device according to the invention.

The device shown in FIG. 1 comprises a body denoted by the numeral 1 surrounding and carrying the device, one end of the body being provided with a pipe stub 2 to form an air intake having an air flow direction shown by the arrow 3. One end, of the body 1 is provided with a flange 4 for attaching to an engine block. Arranged centrally in the body 1 there is a cylindrical cap 5, guiding and carrying a guide means 6 formed with a cylindrical portion 7 slidably arranged along a cylindrical inner surface 8 of the cap 5. The cylindrical portion 7 is provided with sealing rings 9 engaging surface 8. To the cylindrical portion of the cap 5 there is attached a bearing block 10 carrying a spindle 11 to which there is affixed a lever 12. The spindle also carries a pinion 13 which is in engagement with a toothed portion 14 of the cylindrical portion 7 of guide means 6. By operating the lever 12 in the direction of the double arrow 15, guide means 6 is caused to move along the cylindrical inner surface 8 of the cap 5. The lower portion of guide means 6 is shaped into a curved valve-like portion 16 coacting with a complementarily shaped portion 17 of guide body 1, portions 16 and 17 forming an annular duct 18 for air entering through the inlet 2. For limiting the most restricted region in the portion 17 when displacing guide means 6 towards it, bosses 19 of plastic for instance, are provided which the surface of the valve-like portion 16 engages in the most displaced position of guide means 6.

At the top of the cap 5 there is arranged a turbine housing 20 containing a turbine wheel 21 driven by exhaust gases from an internal combustion engine to which body 1 is attached, the exhaust gases being supplied through a pipe 22 and leaving the turbine housing through a pipe 23. The turbine wheel is mounted by means of a ball bearing 24 an portion 25 integral with the body 1 and centrally located in the device. The hub portion of the turbine wheel is shaped as a tube 26 extending through the cap 5 and through the inner portion of guide means 6 down to a rotor 27 which in turn is mounted on a spindle 28 attached to a crosspiece 29 at the attachment flange 4 of the body 1. The rotor 27 is provided with helical flanges 30 for contributing to the flow of the fuel/air mixture going to the engine.

Ducts 31 lead from turbine housing 20 through the portion 25 into a space 32 defined by the portion 25, the rotating tube 26 and an upper portion 33 of the rotor 27. Said portion 33 is pointed, as is apparent from the drawing, to break up the stream of fuel and gases which flow through the space 32. At the foot of the pointed portion 33 there are stator vane-like apertures 34 opening into the duct 18 and also, in the position shown, to a portion in the space 35 formed between the valve-like portion 16 of guide means 6 and the cylindrical surface of the tube 26.

Figure 2:
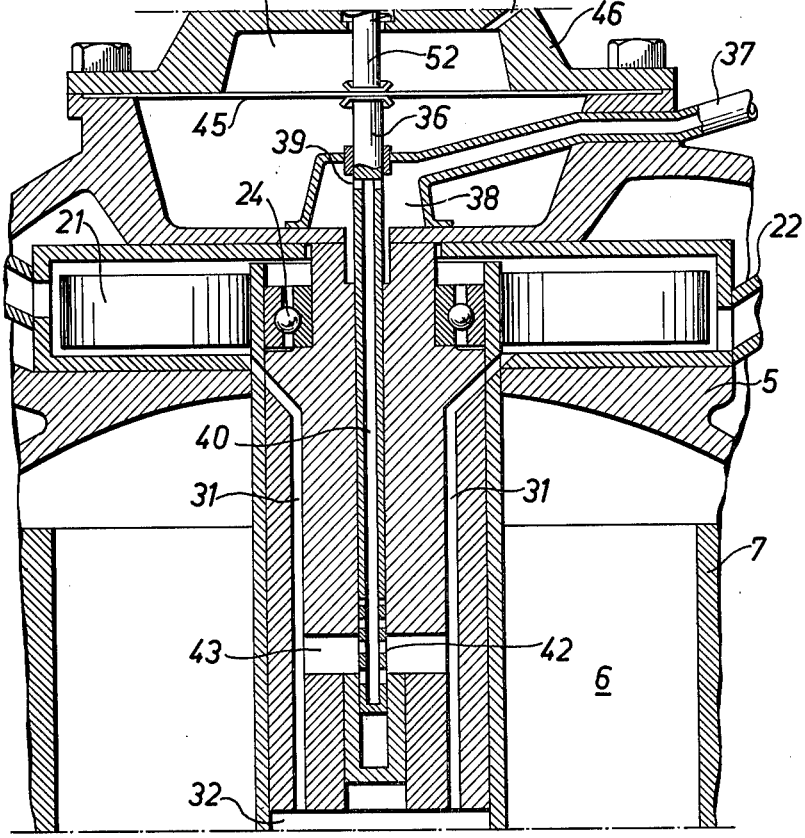
FIG. 2 shows, on an enlarged scale, a central portion of the device shown in FIG. 1.
Figure 3:
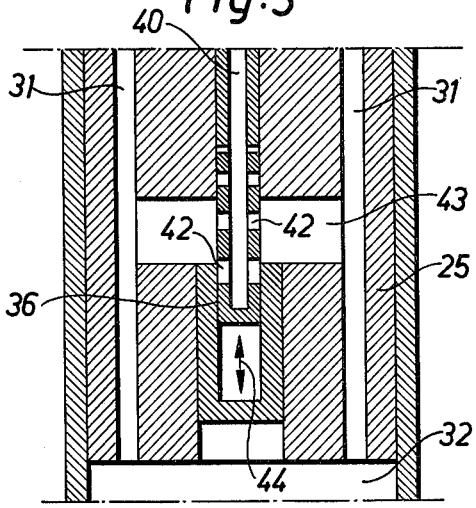
FIG. 3 shows, on a further enlarged scale, a detail from FIG. 2.

A fuel control means is arranged centrally in the portion 25, consisting of a conduit 36 movably arranged in the longitudinal direction of the part 25. Fuel is fed through a pipe 37 to a chamber 38 situated at the upper end of the conduit 36. Said upper end is provided with inlet holes 39 through which the fuel flows down in the conduit bore 40. The structure is clearly seen from FIG. 2. The lower end 41 of the conduit 36 is closed. However, at its lower end the side walls of the conduit are provided with apertures 42 of different sizes, as is clearly apparent from FIG. 3. These apertures are arranged to coact with a bore 43 in the part 25, said bore extending to the ducts 31, and together with these forming an outlet for fuel passing through the conduit 36. By movement of the conduit in the direction of the double arrow 44 in FIG. 3 different aperture areas will coact with the bore 43, whereby different amounts of fuel are allowed to exit into the space 43 and thus into the ducts 31.

Displacement of the conduit 36 is effected by a diaphragm 45 arranged in a space formed by the upper portion of the body 1 and a cover 46. The diaphragm forms the boundary between two chambers 47 and 48. The latter chamber communicates through a pipe 49 with the duct 18 immediately downstream the portion 17 in the body 1 opposite the upper portion of the rotor 27. The chamber 47 is assumed to be in communication with the surrounding atmosphere.

Fuel is supplied through the pipe 37 which communicates with a fuel pressure smoothing means 50, known per se, which smooths out the pulsing feed from the fuel pump. For adjusting the basic position of the conduit 36, a helical spring 51 is arranged to urge a rod 52, which in its turn coacts with the diaphragm 45. The biasing force of the helical spring is adjusted by a set screw 53.

The device functions in the following manner. It is assumed that the internal combustion engine has a certain rpm and that guide means 6 is in the position shown in FIG. 1. In this case air flows in through the pipe stub 2 in the direction shown by the arrow 3. The air flows through duct 18 and past rotor 27 into the engine. The exhaust gases from the engine simultaneously flow into the turbine housing 20 via the pipe 22 and drive the turbine wheel 21, which via the tube 26 also drives the rotor 27. Resulting from the rotation of the rotor 27, its blade means 30 will actively contribute to the flow in the duct. Hot exhaust gases also flow through the ducts 31 down to the space 32. On their way down through the ducts 31 the hot exhaust gases are mixed with the fuel going through the conduit 36, this fuel flowing out through the holes 42 into the bore 43. In the chamber 32 the fuel is vaporized by the action of the hot gases, whereby the concentrated mixture thus obtained is centrifugally discharged with large force through the outlet apertures 34. Taking into account that the tube 26 rotates, the gas mixture in question will be thrust out into the duct 18. The gas is here mixed effectively with the combustion air and forms a homogeneous fuel/air mixture which is supplied to the engine. If lever 12 is pivoted so that guide means 6 comes closer to the portion 17 of the body 1, the through-flow area for the air will be reduced. The engine will thus work at reduced rpm. Simultaneously herewith the sub-pressure present in the pipe 49 will, however, be reduced, whereat the diaphragm 45 is pressed downwardly by the spring biasing adjusting means 53, causing the conduit 36 to move in the part 25. This has the effect that increasingly smaller apertures 42 of the conduit communicate with the bore 43 and the amount of fuel is restricted in proportion thereto.

As is clearly apparent from FIG. 1 no turbulence occurs at the valve-like portion 16 of guide means 6, when this is moved closer to the portion 17 of the body 1, and the air streams will be substantially laminate. The flow of the vaporized fuel also takes place correctly according to flow technology. By controlling the fuel supply and the hot gas feed in relation to the area of the duct 18, the above-mentioned fuel/air relationship can be maintained in a simple way within very large rpm ranges, while extremely even combustion is achieved through the homogenized mixture.

The air ducts can naturally be made in a way other than that shown here. It is, however, essential that regulation of the gas is achieved by varying the through-flow area in a way which is advantageous from the point of view of flow, so that turbulence is avoided as far as possible. Regulation of the fuel supply can naturally take place in a way other than that shown here, it being essential that the fuel supply is in proportion to the flow conditions which occur between the body and guide means 6.

Instead of the differently sized apertures 42 in the conduit 36, an arrangement of slits can be conceived, which are covered to a greater or less extent by displacements of the conduit 36, in such a case said slits should be arranged in the part 25.

The air intake 2 can, for example, also be conceived to open into the duct 18 at the portion 17 opposite the curved valve-like portion 16, whereat for such a case the same control is also obtained as in the one shown.

Dual pipes can be imagined instead of the pipe 49, in order to improve the accelerating capacity of a coacting engine.

What is claimed is:

1. A carburetor device for an internal combustion engine generating exhaust gases under pressure, comprising (a) a combustion air intake duct, (b) a controllable valve means in the air intake duct, (c) means for displacing the valve means into selected positions for adjusting combustion air flow through the duct, (d) a source of fuel supply, (e) a fuel flow regulating means disposed within the valve means, the fuel flow regulating means having an upstream portion connected to the fuel supply source for receiving fuel therefrom and a downstream portion defining fuel distribution outlet means opening into the duct for mixing the fuel with the air therein, (f) means for controlling the fuel flow regulating means in response to the selected position of the valve means, (g) a turbine means mounted on the fuel flow regulating means, the turbine means having a tubular hub portion extending through the valve means and surrounding the fuel flow regulating means, the tubular hub portion being connected to the fuel outlet distribution means, and (h) conduit means delivering exhaust gases generated by the engine to the turbine means for driving the turbine means and thereby rotating the tubular hub portion thereof.

2. The carburetor device of claim 1, further comprising a rotor arranged in the duct and connected to the tubular hub portion, the rotor comprising impeller blade means for positively driving the fuel-air mixture downstream in the duct.

3. The carburetor device of claim 2, further comprising a pointed connecting portion connecting the rotor with the tubular hub portion and extending thereinto, the tubular hub portion and the pointed connecting portion defining a chamber in communication with the fuel distribution outlet means, and conduit means for delivering the exhaust gases driving the turbine means from the engine and the fuel from the fuel flow regulating means to the chamber, the outlet means defining vane-like apertures.

4. The carburetor device of claim 1, wherein the fuel flow regulating means comprises a displaceable tube receiving the fuel from the supply source, a pressure-sensitive diaphragm to which the tube is attached for displacement, the diaphragm being in pressure communication with a chamber connected to the duct downstream of the valve means whereby the pressure in the duct downstream of the valve means is transmitted to the chamber, said pressure controlling movement of the diaphragm for displacement of the tube attached thereto.

5. The carburetor device of claim 4, further comprising a spring-biased setting device for adjusting the position of the diaphragm.

6. The carburetor device of claim 1, wherein the valve means displacing means comprises a cap including a cylindrical portion and a valve body having a cylindrical portion displaceably engaging the cylindrical portion of the cap, and a lever mechanism for displacing the cylindrical portion of the valve body with respect to the cylindrical portion of the cap.

7. The carburetor device of claim 6, wherein the fuel flow regulating means extends centrally through the cap into a downstream portion of the valve means and comprises a displaceable tube receiving the fuel from the supply source through slits in an upstream portion of the tube, and the fuel outlet means defining aperture means adjustable in size in response to the displacement of the tube.

* * * * *